US006343834B1

(12) United States Patent
Wurmlinger

(10) Patent No.: US 6,343,834 B1
(45) Date of Patent: Feb. 5, 2002

(54) COLLAPSIBLE WALL MOUNTED SEAT

(75) Inventor: Ernest H. Wurmlinger, Saskatoon (CA)

(73) Assignee: Hide-A-Seat Manufacturing Corp., Saskatoon (CA)

( * ) Notice: Subject to any disclaimer, the term of this patent is extended or adjusted under 35 U.S.C. 154(b) by 0 days.

(21) Appl. No.: 09/562,855

(22) Filed: May 1, 2000

(51) Int. Cl.[7] ..... A47C 9/06
(52) U.S. Cl. ..... 297/14; 108/47; 108/134
(58) Field of Search ..... 297/13, 14; 108/47, 108/48, 134; 312/242, 248, 313, 315

(56) References Cited

U.S. PATENT DOCUMENTS 1,582,380 A * 4/1926 Carpenter et al. ..... 108/134 X
1,712,704 A * 5/1929 Kiser ..... 312/242 X
2,743,976 A * 5/1956 Gaston ..... 108/134 X
2,943,896 A * 7/1960 Gaston ..... 108/134 X
4,927,107 A * 5/1990 Mateo Maria ..... 108/134

* cited by examiner

*Primary Examiner*—Anthony D Barfield
(74) *Attorney, Agent, or Firm*—Adrian D. Battison; Michael R. Williams

(57) ABSTRACT

A collapsible wall mounted seat comprising a linkage mount for fixing to a wall, a seat for supporting a person, and a linkage connecting the seat to the linkage mount. The linkage includes a first end and a second end and is connected at the first end to the linkage mount and at the second end to the seat. The linkage is movable between a folded position with the seat lying adjacent and substantially parallel to the wall, and an extended position with the seat extending outwards from and substantially perpendicular to the wall. The collapsible wall mounted seat includes a releasable lock for unlocking the linkage in the extended position.

20 Claims, 7 Drawing Sheets

COLLAPSIBLE WALL MOUNTED SEAT

FIELD OF THE INVENTION

The present invention relates to collapsible seats, particularly of the type for mounting on a wall or similar vertical surface.

BACKGROUND OF THE INVENTION

Most entrance areas of a home and many other buildings do not have enough room for a chair to be used when putting on or removing footwear. This problem can also exist in other rooms in the house or building where inadequate space does not permit the use of a full sized chair.

SUMMARY OF THE INVENTION

The collapsible wall mounted seat provides a seat which can be used where inadequate space does not permit the use of a full sized chair. The collapsible wall mounted seat can be installed on any wall or other similar vertical surface and folds easily and neatly against the wall when not in use.

According to one aspect of the invention there is provided a collapsible seat for mounting on a wall, said seat comprising:

a seat panel with top and bottom sides;

seat hinge means for mounting the seat panel on a wall for movement between a stowed position with the bottom side of the seat panel facing the wall and a use position projecting from the wall;

an overcenter linkage for supporting the seat panel in the use position, the linkage comprising;

a first link;

linkage mounting means for pivotally mounting the first link on the wall;

a second link;

link pivot means pivotally connecting the first and second links at a position spaced along the first link from the linkage mounting means;

linkage hinge means pivotally mounting the second link on the bottom side of the seat panel at a position spaced from the link pivot means; the linkage having a folded condition along the bottom side of the seat panel in the stowed position of the panel and an extended, overcenter condition with the first and second links forming an obtuse angle confronting the seat hinge means in the extended position of the seat;

linkage retaining means for retaining the linkage in the extended, overcenter condition; and linkage release means for releasing the linkage from the extended, overcenter condition.

The linkage retaining means may be a tension member connecting the linkage to the seat panel. In one embodiment the tension member is a foldable link and the linkage release means is a spring loaded cable with a handle mounted under the front of the seat panel for moving the link pivot towards the seat panel and moving the linkage past its overcenter condition. This allows the linkage to fold and the seat panel to drop to the stowed position.

The second link of the linkage may be slightly longer than the first link. With the appropriate positioning of the hinges, this puts the linkage into a second overcenter condition in the stowed position of the seat panel. The seat panel is then held positively against the wall in the stowed position.

The seat may be mounted on a wall surface, or it may be recessed into a wall. The recessed arrangement is particularly suited to stud walls with drywall paneling.

In alternative arrangement, there may be provided a recessed portion in the bottom side of the seat panel, the recessed portion being suitably sized so as to receive the overcenter linkage therein in the folded condition. The linkage as well and the retaining and release means can thus be fully enclosed within the seat panel in the stowed position without requiring the seat to be recessed into a wall.

When there is provided a recessed portion in the seat panel, the seat hinge means preferably comprises a hinge arranged to be supported on the wall, the hinge being mounted within the recessed portion of the seat panel such that the seat hinge means is received within the recessed portion of the seat panel when the seat panel is in the stowed position.

In one arrangement, the linkage release means may comprises a crank element mounted on the foldable link defining a bell crank such that deflection of the crank element acts in a direction to collapse the foldable link and release the linkage retaining means.

When there is provided a crank element, the linkage release means preferably comprises a release member coupled to the crank element and wherein there is provided biasing means coupled to the release member being oriented in a direction such that the tension member maintains the overcenter linkage in the overcenter condition.

BRIEF DESCRIPTION OF THE DRAWINGS

In the accompanying drawings, which illustrate exemplary embodiments of the present invention.

is a side view of a first embodiment of the wall mounted seat in the extended, use position and mounted directly on a wall.

DETAILED DESCRIPTION

Figure 1:
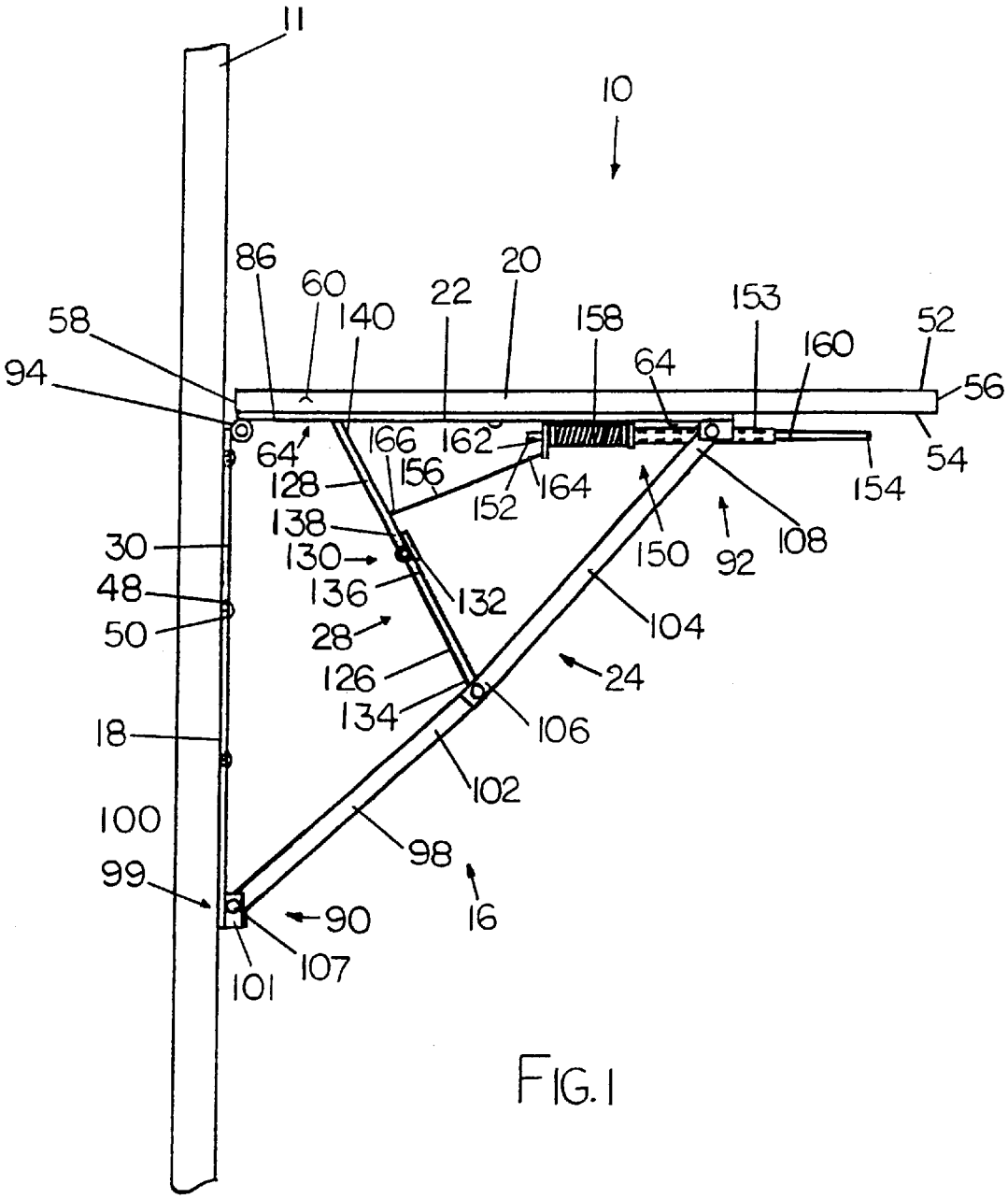
Figure 2:
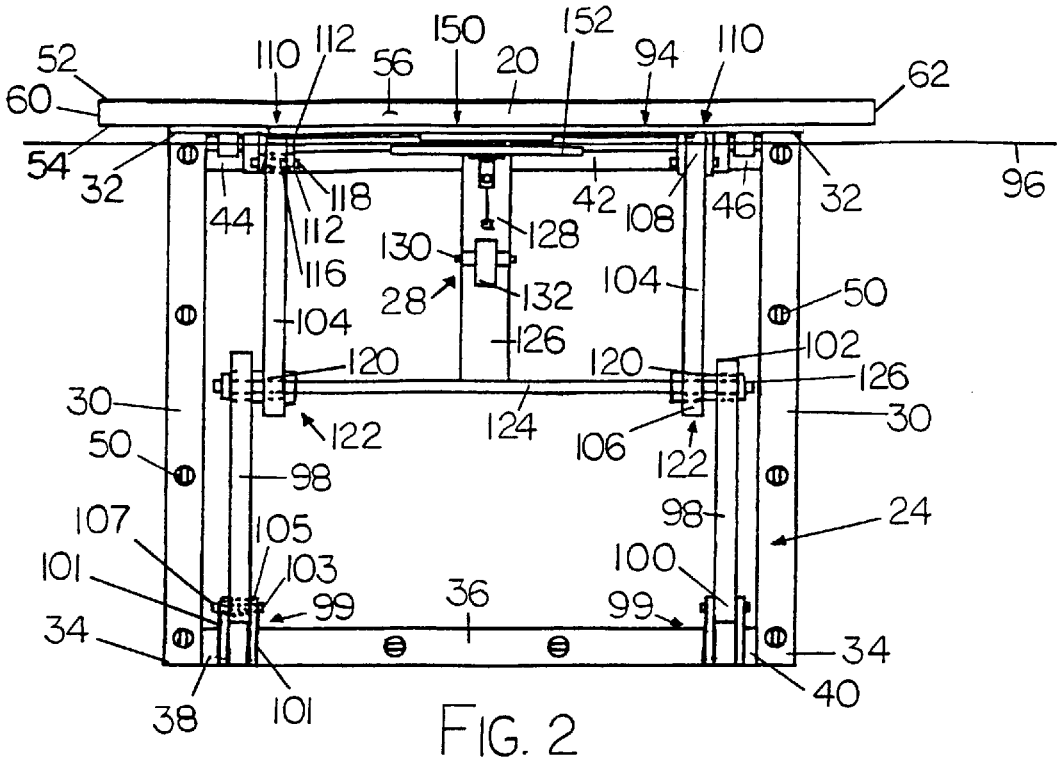
FIG. 2 is a front view of the wall mounted seat of FIG. 1.
Figure 3:
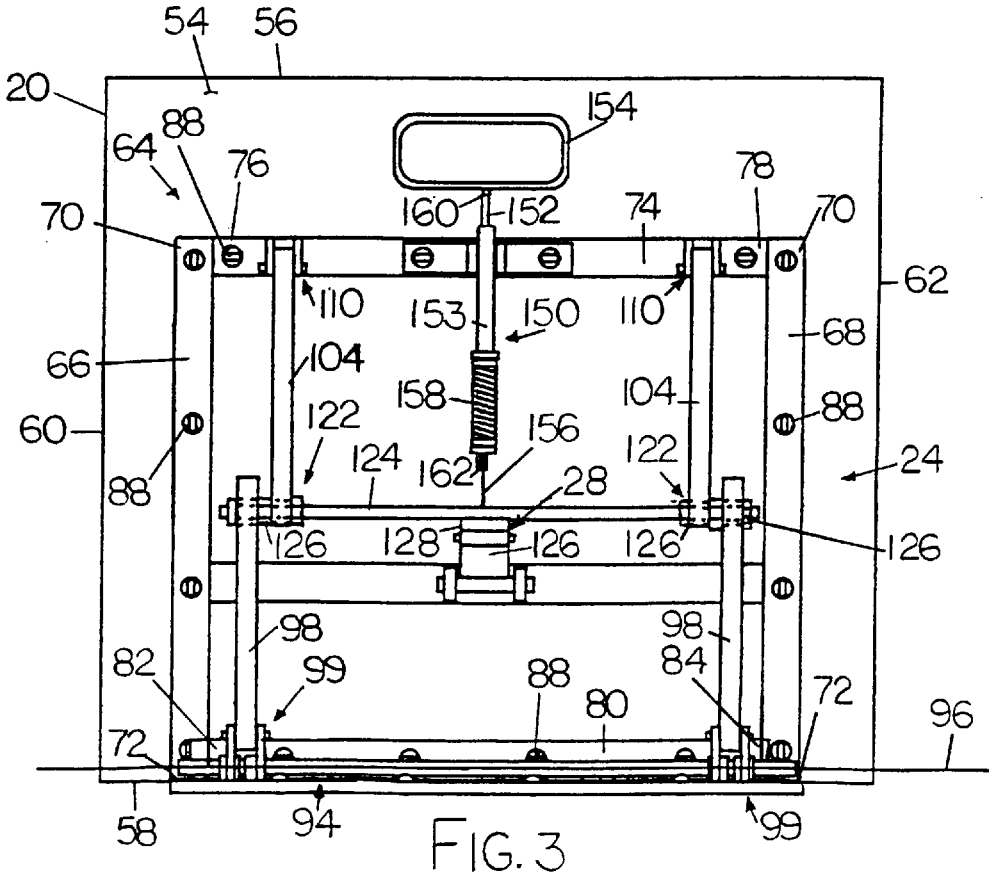
FIG. 3 is a bottom view of the wall mounted seat of FIG. 1.

Referring to FIGS. 1 to 5 the collapsible wall mounted seat, shown generally at 10, mounts on a wall 11 and is movable between a folded, stowed position 14 (FIG. 5) and an extended, use position 16. The collapsible wall mounted seat 10 has a mounting fame 18 for mounting the seat on the wall 11. A seat panel 20 is mounted on a seat frame 22. An overcenter linkage 24 connects the seat frame 22 to the mounting frame 18. The linkage 24 is movable between a folded condition with the seat panel 20 in its stowed position, lying adjacent and parallel to the wall 11, and an extended, overcenter condition with the seat panel 20 extending outwards from and perpendicular to the wall 11.

The mounting frame 18 is a rectangular frame including two vertical elongate plates 30 spaced apart from one another and arranged for engaging a face 13 of the wall 11.

Each plate 30 has a top end 32 and a bottom end 34. A bottom plate 36 extends between the bottom ends of the vertical plates 30, perpendicular thereto. The bottom plate 36 has its ends 38 and 40 fixed to the respective bottom ends 34 of the vertical plates 30. Likewise a top plate 42 extends between the vertical plates 30 and has its ends 44 and 46 fixed to the top ends 32 of the respective plates 30.

A plurality of screw holes 48 extend through each of the plates 30, 36, and 42. The holes 48 are spaced apart along the plates 30, 36, and 42 and receive screws 50 for fastening the mounting frame 18 onto the wall 11.

The seat frame 22 mounts the seat panel 20 on the mounting frame 18 and on the linkage 24. The seat frame 22 is a rectangular frame including two spaced apart elongate plates 66 and 68 mounted on the bottom side 54 of the seat panel 20. The plates 66 and 68 lie adjacent and along the left and right sides 60 and 62 respectively of the seat panel 20. A front elongate plate 74 extends between the left and right elongate plates 66 and 68. The front plate 74 has first and second ends 76 and 78 fixed to the front ends 70 of the plates 66 and 68. Likewise a rear elongate plate 80 extends between the plates 66 and 68 and has its ends 82 and 84 fixed to the rear ends 72 of the plates 66 and 68.

A plurality of screw holes 86 extend through each of the plates 66, 68, 74, and 80. The holes 86 are spaced apart along the plates and receive screws 88 fastening the seat frame 22 to the seat panel 20.

The linkage 24 is connected at its bottom end 90 to the mounting frame 18 and at its top end 92 to the seat frame 22. The linkage 24 is movable between the folded condition with the seat panel 20 in its stowed position adjacent and substantially parallel to the wall 11 and the extended, overcenter position with the seat panel 20 in its use position, extending outwards from and substantially perpendicular to the wall 11. This enables the collapsible wall mounted seat 10 to be folded downward and out of the way when not in use.

A seat hinge 94 extends laterally across the rear side 58 of the seat panel 20 and has an axis of rotation 96 parallel to the rear side 58 of the seat panel 20. The hinge 94 is fixed to the top plate 42 of the mounting frame 18 and to the rear plate 80 of the seat frame 22 on the bottom face 54 and adjacent the rear side 58 of the seat panel 20.

The linkage 24 has a first link including a pair of first elongate link members 98 which are spaced apart laterally from one another and spaced inwards from the sides of the seat. Each of the first link members 98 has a first end 100 pivotally connected to the mounting frame 18 by a linkage mounting pivot connection 99. The pivot connection includes, for each of the link members, a pair of spaced apart flanges 101 fixed to the bottom plate 36 of the mounting frame 18 on opposite sides of the link member 98. Aligned holes 103 extend laterally through the flanges 101, in alignment with a hole 105 at the first end 100 of the first link member 98. A pivot pin 107 extends through the holes 103 and 105 and pivotally mounts the linkage on the mounting frame.

The linkage 24 also has a second link including pair of laterally spaced second elongate link members 104. The second elongate link members 104 are spaced inwards from the first link members 98. Each of the second link members 104 has first and second ends 106 and 108. The second end 108 is pivotally connected to the front plate 74 of the seat frame 22 by a linkage hinge 110. The linkage hinge comprises a pair of spaced apart flanges 112 fixed to the front plate 74 of the seat frame 22 on opposite sides of the second link member 104. Aligned holes 114 extend through the flanges 112 in alignment with a hole 116 in the second end 108 of the second link member 104. A pin 118 extends through the holes 114 and 116 and pivotally mounts the linkage on the seat frame 22.

A hole 120 extends laterally through the second end 102 of each of the first elongate link members 98 and through the first end 106 of each of the second elongate linkage members 104. The holes 120 are aligned with one another. A linkage pivot 122 includes an elongate pin 124 extending through the aligned holes 120 to pivotally connect the second ends 102 of the first link members 98 to the first ends 106 of the second link members 104 such that the first and second elongate linkage members 98 and 104 can pivot relative to one another. Retainers 126 hold the pin 124 in place between the link members 98 and 104.

The second link members 104 are slightly longer than the first link members 98. When the seat panel 20 is in the stowed position, the linkage hinge 110 passes to an overcenter position slightly behind the linkage mount 99. This requires a small resilient deformation of the linkage as the linkage goes overcenter. The linkage then serves to hold the seat panel against the wall.

When the seat panel 20 is in the extended position the first and second link members 98 and 104 are in another overcenter position, forming an obtuse angle confronting the hinge 94. The first end 100 of each first linkage member 98 and the second end 108 of each second linkage member 104 lies slightly out of alignment with a line joining the linkage mounting pivot 99 and the linkage hinge 110 in this position. This prevents the linkage from folding upwardly into the folded condition when a downward load is placed on the seat panel. To prevent the linkage from folding downwards, a linkage retainer 28 extends from the seat frame 22 to the linkage 24.

The linkage retainer 28 is a foldable link including a first retainer link 126 and a second retainer link 128 joined by a pivot connection 130. A stop 132 limits the folding movement of the retainer. The first retainer link 126 has first and second ends 134 and 136. It is pivotally connected at the first end 134 to the pin 124 of the linkage pivot 122. The second retainer link 128 has first and second ends 138 and 140. It is pivotally connected at the second end 140 to the seat panel 20 at a location spaced from the rear side 58 of the seat panel 20.

The pivot connection 130 pivotally connects the second end 140 of the first retainer link 126 to the first end 138 of the second retainer link 128. The pivot connection 130 allows the first and second retainer links 126 and 128 to pivot relative to one another.

The stop 132 is fixed to the first retainer link 126 adjacent the pivot connection 130 and facing the seat panel 20. The stop 132 extends across the pivot connection 130 to engage the second retainer link 128 when the linkage is in the extended condition.

In the extended condition the first and second retainer links 126 and 128 are aligned with one another and act in tension to prevent the overcenter linkage 24 from folding beyond the overcenter extended condition, which would allow the seat panel to drop.

Figure 4:
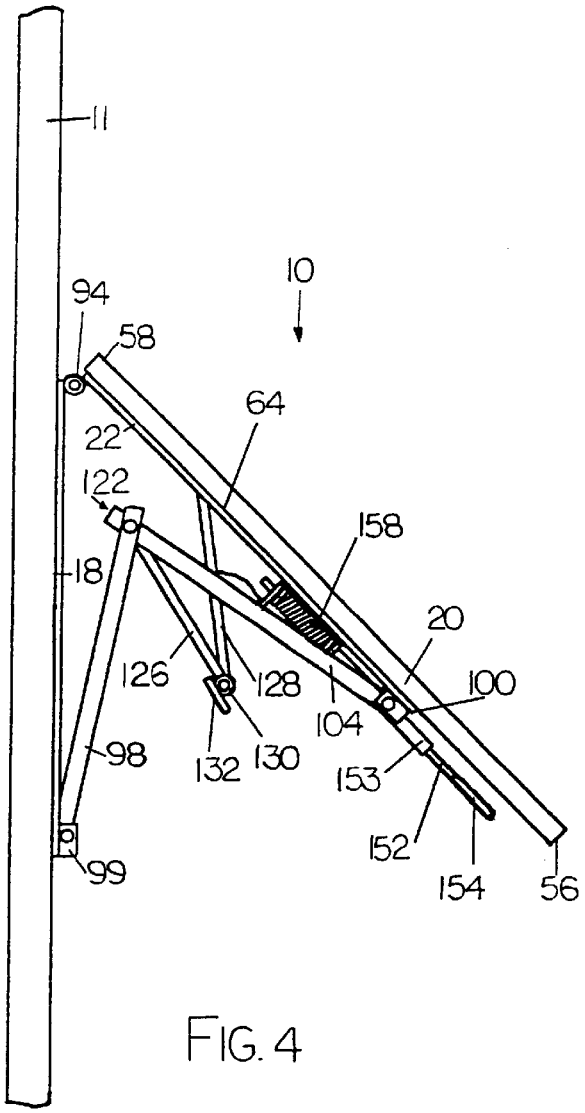
FIG. 4 is a side view of the wall mounted seat FIG. 1 in a position lying between the extended position and the folded position.
Figure 5:
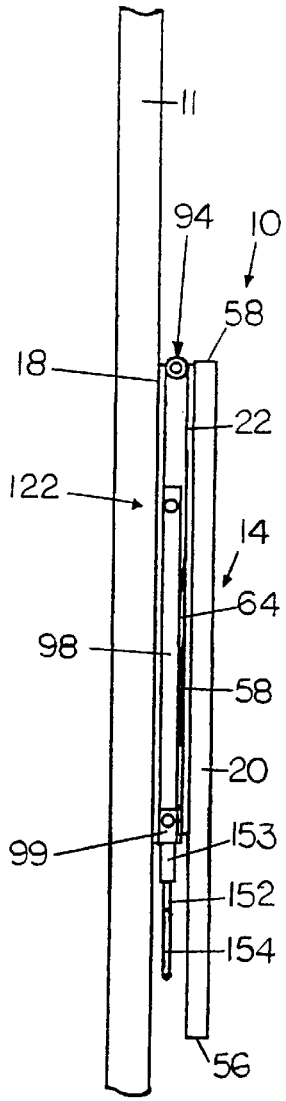
FIG. 5 is a side view of the wall mounted seat of FIG. 1 in the folded position.

In the stowed condition of the seat, the retainer links 126 and 128 are folded opposite to the overcenter linkage, as shown most clearly in FIG. 4.

A release mechanism 150 is used for releasing the overcenter linkage 24 to allow the seat panel 20 to move into the stowed position 14. The release mechanism includes a rod 152 slidably mounted in a tube 153 mounted on the bottom side 54 of the seat panel 20. A handle 154 is fixed to an outer end 160 of the rod 152. A release cable 156 has one end 164 fixed to an inner end 162 of the rod 152 and an opposite second end 166 connected to the first retainer link 126. A coil spring 158 surrounds the rod and acts between the end of the tube 153 and a flange 159 on the rod 152 to bias the rod towards the rear 58 of the seat panel 20.

Pulling on the handle 154 causes the rod 152 to draw the cable 156 towards the front side 56 of the seat panel 20, causing the retainer links 126 and 128 to fold forwards. This draws the pin 124 of the linkage pivot 122 upwards towards the folded condition 14 and out of the overcenter condition, allowing the weight of the seat panel 20 to fold the linkage to the folded condition, and moving itself to the stowed position.

Figure 6:
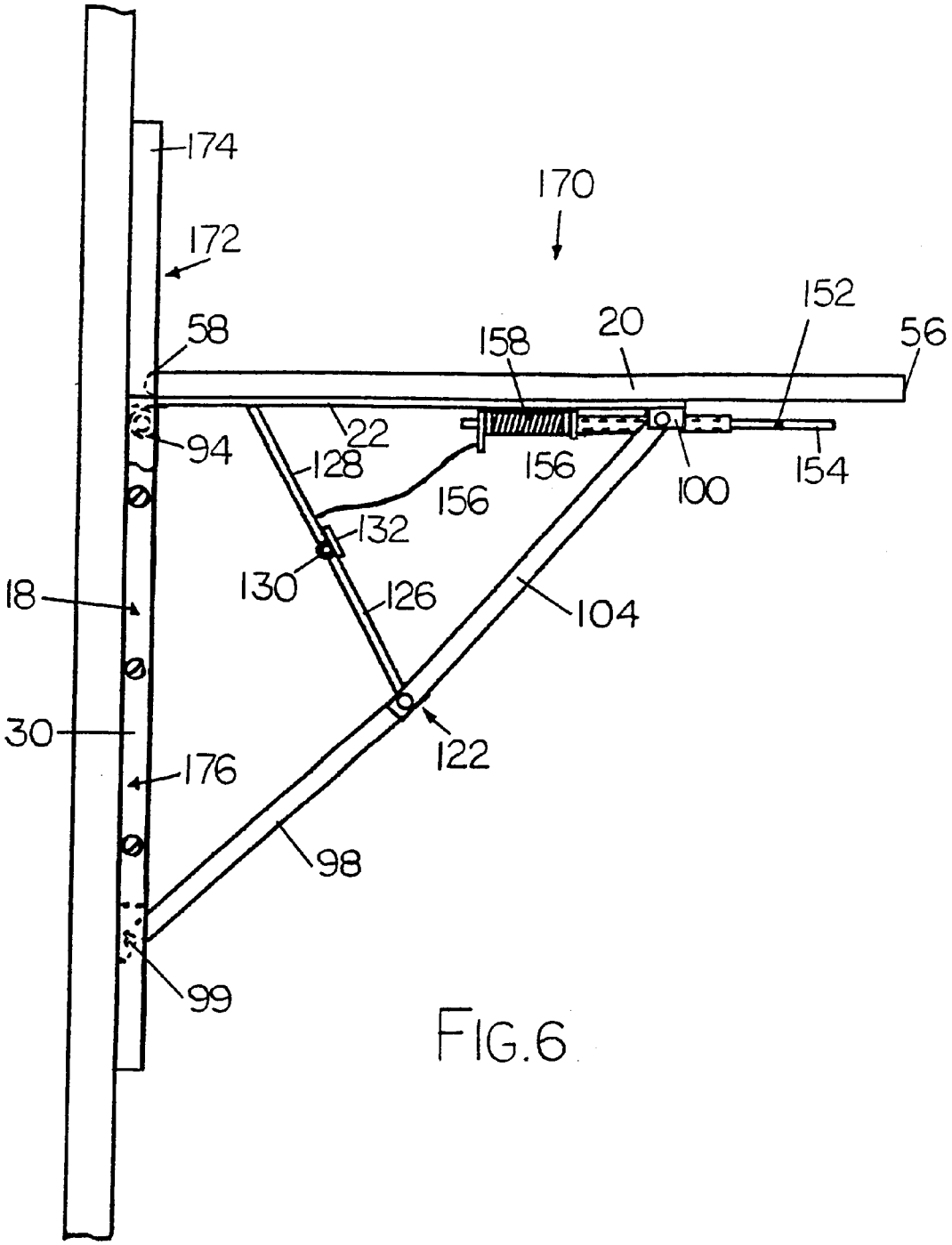
FIG. 6 is a side view of an alternative embodiment of the wall mounted seat.
Figure 7:
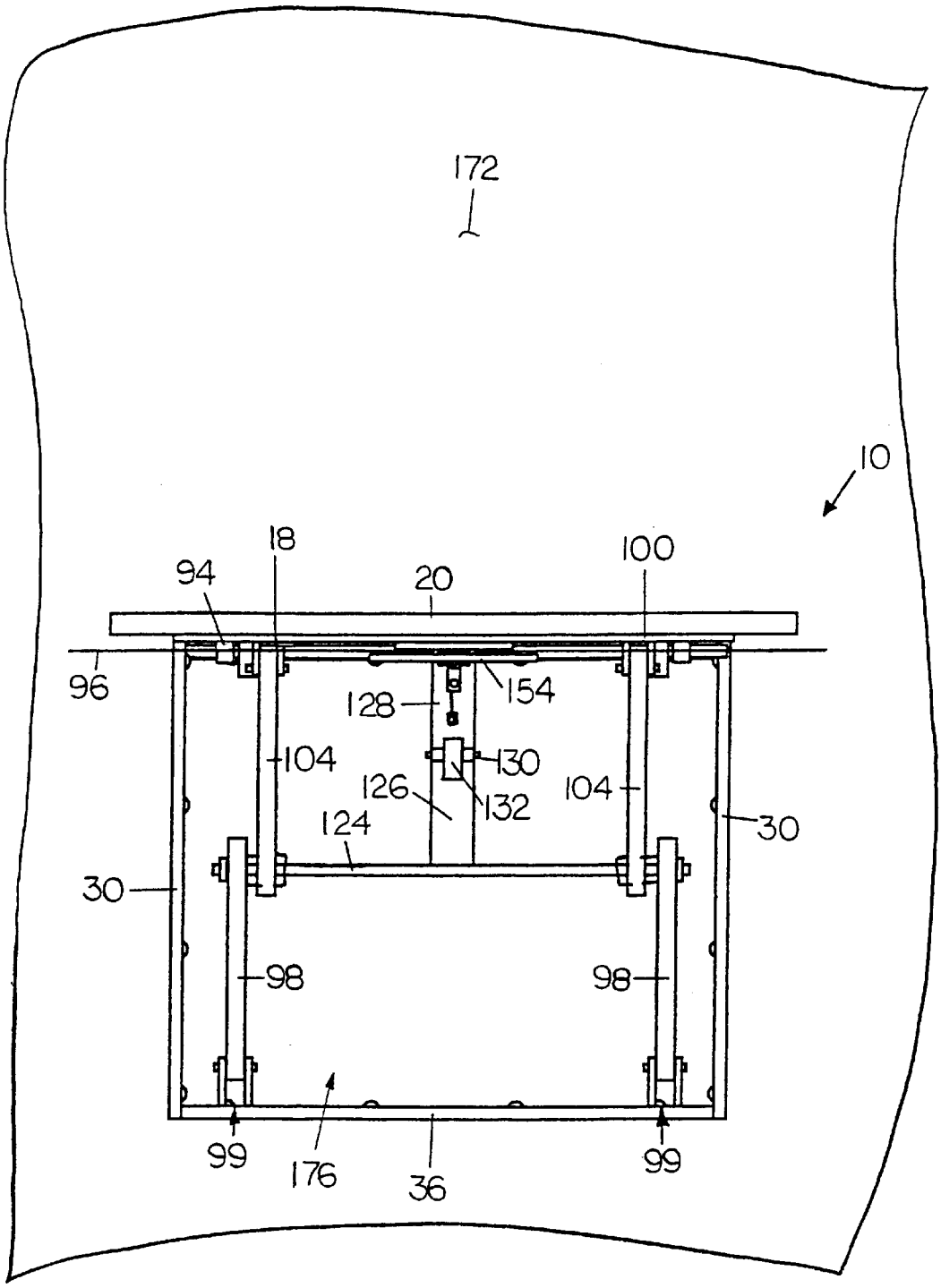
FIG. 7 is a front view of the wall mounted seat of FIG. 6.

Referring to FIGS. 6 and 7, an alternative embodiment of wall mounted seat 170 for recessed mounting in an opening in a wall 172 is shown In this embodiment the plates 30, 36 and 42 of the mounting frame 18 are arranged at 90 degrees to that in the above arrangement for engaging around the periphery of the opening.

The opening 176 in the wall is sized and arranged to receive the mounting frame 18 with the plates 30, 36, and 40 engaging the periphery of the opening. The mounting frame 18 is fixed within the opening 176 such that when the seat panel 20 is in the folded position, it lies flush on the wall 11. The seat panel 20 is sized to cover the opening 176 in the wall 172.

The wall mounted seat may be mounted on any appropriate vertical surface, for example a column, or the side of a work bench, which are for the purposes of this application considered to be walls.

Figure 8:
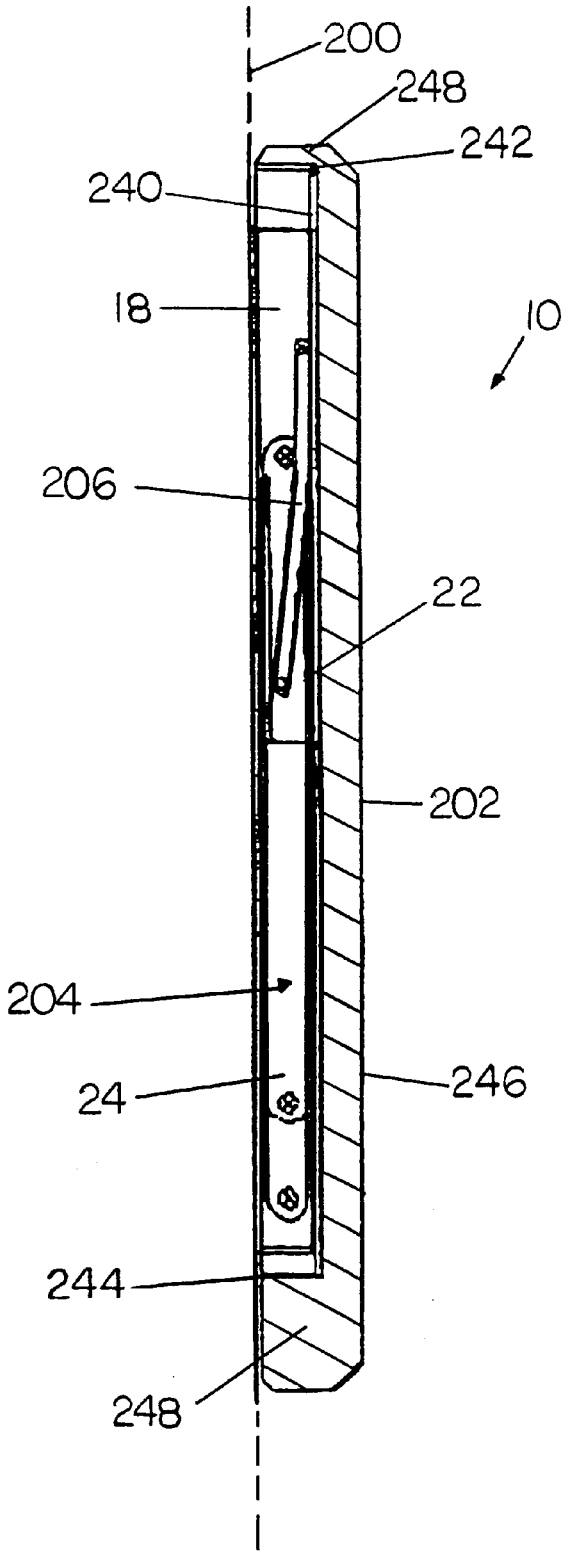
FIG. 8 is a side view of a further embodiment of the wall mounted seat in the folded position.
Figure 9:
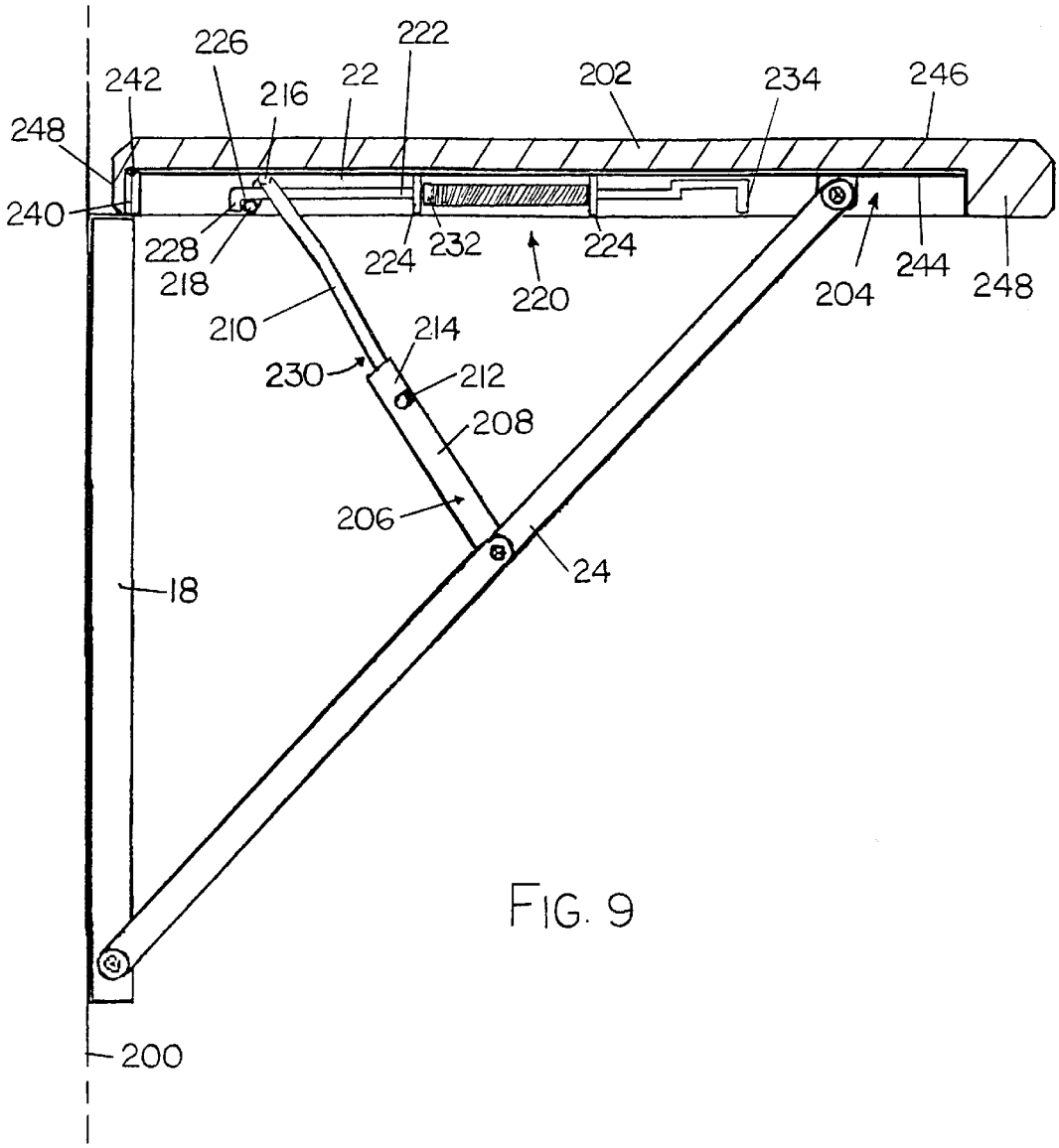
FIG. 9 is a side view of the wall mounted seat of FIG. 8 in the extended position.

In the alternative embodiment of FIGS. 8 and 9, the collapsible wall mounted seat 10 is shown mounted on a supporting surface 200, for example a wall or other similar upright surface. The seat 10 includes a generally rectangular seat panel 202 having a recessed portion 204 on an inner face thereof. The recessed portion 204 is substantially rectangular and suitably sized to receive the overcenter linkage 24 therein when the seat is in the folded, stowed position shown in FIG. 8 such that the mounting frame 18, as described in the first embodiment, can be mounted directly on the supporting surface 200 while still being hidden from view by the seat panel 202 in the folded position.

The mounting frame 18 and the overcenter linkage 24 of FIGS. 8 and 9 are assembled as described in the first embodiment for supporting the seat panel 202 in the extended use position of FIG. 9 with the linkage 24 in the overcenter position. A seat frame 22 as in the first embodiment is mounted within the recessed portion 204 of the seat panel for mounting the overcenter linkage 24 thereon. A retainer linkage 206 supports the overcenter linkage 24 in the overcenter position as shown in FIG. 9 similarly to the retainer 28 of the first embodiment to support the seat panel in the extended use position.

The retainer linkage 206 includes a first link 208 and a second link 210 wherein the first link comprises a channel member pivotally mounted the second link therein at a pivot connection 212 such that an end of the channel member defines a stop 214 for securing the retainer linkage 206 in an extended position as shown in FIG. 9. An inner end 216 of the second link is pivotally mounted to the seat panel within the recessed portion 204. A crank portion 218 extends outwardly from the inner end 216 of the second link transversely to the second link such that the second link defines a bell crank arrangement. A release mechanism 220 is provided similar to the release mechanism 150 of the first embodiment for engaging the crank portion 218 of the second link to release the retainer linkage 206 and the seat 10 from their respective extended positions.

The release mechanism 220 includes an elongate rod 222 which is slidably mounted on the inner side of the seat panel within the recessed portion by a pair of spaced apart mounts 224 having apertures therein to receive the rod 222 therethrough. An inner end 226 of the rod 222 includes a hook portion 228 for engaging the crank portion 218 of the second link to pivot the second link in direction indicated by arrow 230 out of the extended position when the rod 222 is displaced in a longitudinal direction away from the supporting surface 200.

A retainer 232 is mounted on the rod 222 for mounting a spring between the retainer 232 and one of the mounts 224. The rod is thus biased towards the surface 200 when the rod 222 is pulled away from the surface such that the retainer linkage is biased towards the extended position for maintaining the seat securely in the extended position. A handle 234 is mounted on an outer end of the rod 222, opposite the hook portion 228 to provided a grip for a person to urge the rod and retainer linkage 206 out of the extended use position of FIG. 9 as desired, so that the seat 10 may be subsequently stored in the folded, stowed position of FIG. 8.

The mounting frame 18 includes an upper mounting flange 240 having a hinge 242 which is mounted within the recessed portion 204 of the seat panel 202. The recessed portion 204 of the seat panel includes a structural metallic liner 244 surrounded on an outer side thereof by a plastic shell 246 with a layer of supportive material therebetween. The shell 246 and liner 244 define side flanges 248 which surround the recessed portion 204 such that the flange 248 alongside the mounting flange 240 extends between the mounting flange and the surface 200 in the extended position shown in FIG. 9 for concealing the hinge 242 within the recessed portion in the extended position. The side flanges 248 of the seat panel 202 are also arranged to surround the mounting frame 18 and the seat frame 22 which enclose the overcenter linkage 24 and the retainer linkage 206 therebetween in the folded, stowed position of FIG. 8 such that the frames are concealed by the seat panel in the folded position.

Since various modifications can be made in my invention as herein above described, and many apparently widely different embodiments of same made within the spirit and scope of the claims without departing from such spirit and scope, it is intended that all matter contained in the accompanying specification shall be interpreted as illustrative only and not in a limiting sense.

What is claimed is:

1. A collapsible seat for mounting on a wall, said seat comprising:

a seat panel with top and bottom sides;

seat hinge means for mounting the seat panel on a wall for movement between a stowed position with the bottom side of the seat panel facing the wall and a use position projecting from the wall;

a linkage for supporting the seat panel in the use position, the linkage comprising;

a first link;

linkage mounting means for pivotally mounting the first link on the wall;

a second link;

link pivot means pivotally connecting the first and second links at a position spaced along the first link from the linkage mounting means;

linkage hinge means pivotally mounting the second link on the bottom side of the seat panel at a position spaced from the link pivot means;

the linkage having a folded condition along the bottom side of the seat panel in the stowed position of the panel and an extended condition in which the linkage is extended in relation to the folded condition in the extended position of the seat;

linkage retaining means for retaining the linkage in the extended condition, the linkage retaining means comprising a first tension link and a second tension link, the first tension link being pivotally connected at a first end to the linkage and extending therefrom to a second end, the second tension link being pivotally connected at a second end to the seat panel at a location spaced from a rear side of the seat panel and extending therefrom to a first end, the second end of the first tension link and the first end of the second tension link being pivotally coupled together by a pivot connection for movement with the linkage between the folded condition and the extended condition;

wherein when the linkage is in the extended condition, the first and second tension links are substantially aligned with one another so as to be arranged to be supported under tension to restrict displacement of the link pivot means away from the wall; and wherein when the linkage is in the folded condition, the first and second-tension links are folded at the pivot connection; and linkage release means for releasing the linkage and the linkage retaining means from the extended condition.

2. The seat according to claim 1 wherein the linkage release means comprise means for folding the linkage retaining means and moving the pivot connection towards the seat panel.

3. The seat according to claim 1 wherein:

the first link includes a pair of first elongate link members spaced apart laterally from one another;

the second link includes a pair of second elongate link members spaced apart laterally from one another; and the link pivot means comprise aligned holes through the first and second elongate link members and a pin extending through the aligned holes.

4. The seat according to claim 3 wherein the second elongate link members al positioned between the first elongate link members.

5. The seat according to claim 4 wherein the linkage connection means are arranged such that when in the folded position the first and second elongate linkage members lie substantially parallel to one another and are substantially coplanar.

6. The seat according to claim 4 wherein the linkage mount comprises:

a pair of spaced apart substantially vertical elongate straps each having a top end and a bottom end and being arranged to lie adjacent and spaced outwards from a respective one of the second linkage members; and a bottom elongate strap having a first end and a second end and being fixed at the first end to the bottom end of one of the pair of vertical elongate straps and at the second end to the bottom end of the other of the pair of vertical elongate straps.

7. The seat according to claim, 6 wherein the elongate strap members are arranged for engaging a face of the wall.

8. The seat according to claim 6 wherein the elongate strap members are arranged for engaging around a periphery of an opening.

9. The seat according to claim 3 wherein the first and second elongate linkage members are pivotally connected such that when the seat is in the folded position the first and second elongate linkage members extend towards the hinge and the rear side of the seat with the first end of each first linkage member and the second end of each second linkage member lying adjacent the hinge and such that when in the extended position the first and second elongate linkage members are substantially aligned with one another extending slightly away from the hinge and towards the front side of the seat with the first end of each first linkage member and the second end of each second linkage member lying slightly out of alignment with one another.

10. The seat according to claim 1 wherein the linkage release means include:

a release member having a first end and a second end and being mounted on the bottom face of the seat such that the first end lies adjacent the front side thereof, the second end of the release member being coupled to the second tension link; and a handle member fixed at the first end of the release member;

and wherein actuating the handle member away from the hinge means causes the release member to draw the second tension link towards the front side of the seat causing the first and second tension links to fold at the pivot connection allowing the linkage connection means to move upwards and rearwards towards the hinge thereby moving the first and second linkage members towards the folded position.

11. The seat according to claim 1 including a wall mounting member comprising:

a plate member for fixing on the wall;

and an opening extending through the plate member, said opening being sized and arranged to receive the linkage therein;

and wherein the linkage mounting means mount the linkage within the opening such that when the seat is in the folded position the first and second elongate linkage members lie substantially parallel to one another and are substantially coplanar with one another had the plate member and such that the seat lies adjacent and substantially parallel to the wall.

12. The seat according to claim 11 wherein the seat is sized and arranged to cover the opening in the plate member when in the folded position thereby hiding the linkage from view.

13. The seat according to claim 1 wherein the linkage release means comprises a crank element mounted on the second tension link defining a bell crank such that deflection of the crank element away from the wall acts in a direction to fold the first and second tension links towards the seat panel and release the linkage retaining means.

14. The seat according to claim 13 wherein the linkage release means includes a release member coupled to the crank element and wherein there is provided biasing means coupled to the release member being oriented in a direction to urge the linkage release means into the extended condition.

15. The seat according to claim 1 wherein there is provided a recessed portion in the bottom side of the seat panel, the recessed portion being suitably sized so as to receive the linkage therein in the folded condition, the seat hinge means comprising a hinge arranged to be supported on the wall, the hinge being mounted within the recessed portion of the seat panel such that the seat hinge means is received within the recessed portion of the seat panel when the seat panel is in both the stowed and use positions.

16. The seat according to claim 1 wherein the first end of the first tension link is pivotal about a fixed pivot on the linkage and wherein the second end of the second tension link is pivotal about a fixed pivot on the seat panel.

17. A collapsible seat for mounting on a wall, said seat comprising:

a seat panel with top and bottom sides;

seat hinge means for mounting the seat panel on a wall for movement between a stowed position with the bottom side of the seat panel facing the wall and a use position projecting from the wall;

a linkage for supporting the seat panel in the use position, the linkage comprising;

a first link;

linkage mounting means for pivotally mounting the first link on the wall;

a second link;

link pivot means pivotally connecting the first and second links at a position spaced along the first link from the linkage mounting means;

linkage hinge means pivotally mounting the second link on the bottom side of the seat panel at a position spaced from the link pivot means;

the linkage having a folded condition along the bottom side of the seat panel in the stowed position of the panel and an extended condition in which the linkage is extended in relation to the folded condition in the extended position of the seat;

linkage retaining means for retaining the linkage in the extended condition, the linkage retaining means comprising:

a first tension link and a second tension link, the first tension link being pivotally connected at a first end to the linkage and extending therefrom to a second end, the second tension link being pivotally connected at a second end to the seat at a location spaced from a rear side of the seat and extending therefrom to a first end, the second end of the first tension link and the first end of the second tension link being pivotally coupled together by a pivot connection for movement with the linkage between the folded condition and the extended condition;

and a stop fixed to one of the first or second tension links adjacent the pivot connection and facing the seat panel, said stop being arranged to extend across the pivot connection engaging the other one of the first or second tension links when the tension links are substantially aligned with one another in the extended condition;

wherein when the seat panel is in the extended position, the first and second tension links are substantially aligned with one another extending slightly towards the wall with the stop engaging both the first and second tension links such that the first and second tension links are prevented from pivoting relative to one another past the substantially aligned position in a direction towards the wall thereby locking the seat panel in the extended position; and wherein when the seat panel is in the folded position, the first and second tension links are folded at the pivot connection to extend away from the wall with the second end of the first tension link and the first end of the second tension link adjacent the front side of the seat; and linkage release means for releasing the linkage and the linkage retaining means from the extended condition.

18. The seat according to claim 17 wherein the linkage release means comprises a crank element mounted on the second tension link defining a bell crank such that deflection of the crank element away from the wall acts in a direction to fold the first and second tension links towards the seat panel and release the linkage retaining means.

19. A collapsible seat for mounting on a wall, said seat comprising:

a seat panel with top and bottom sides, the seat panel having a recessed portion within the bottom side thereof;

seat hinge means for mounting the seat panel on a wall for movement between a stowed position with the bottom side of the seat panel facing the wall and a use position projecting from the walls the seat hinge means comprising a hinge arranged to be supported on the wall, the hinge being mounted within the recessed portion of the seat panel such that the hinge is received within the recessed portion of the seat panel when the seat panel is in both the stowed and use positions;

a linkage for supporting the seat panel in the use position, the linkage comprising;

a first link;

linkage mounting means for pivotally mounting the first link on the wall;

a second link;

link pivot means pivotally connecting the first and second links at a position spaced along the first link from the linkage mounting means;

linkage hinge means pivotally mounting the second link on the bottom side of the seat panel at a position spaced from the link pivot means;

the linkage having a folded condition along the bottom side of the seat panel in the stowed position of the panel and an extended condition in which the linkage is extended in relation to the folded condition in the extended position of the seat;

the recessed portion in the bottom side of the seat panel being suitably sized so as to completely receive the linkage therein with sides of the recessed portion surrounding the linkage and the linkage mounting means in the folded condition;

linkage retaining means for retaining the linkage in the extended condition, the linkage retaining means comprising a first tension link and a second tension link, the first tension link being pivotally connected at a first end to the linkage and extending therefrom to a second end, the second tension link being pivotally connected at a second end to the seat panel at a location spaced from a rear side of the seat panel and extending therefrom to a first end, the second end of the first tension link and the first end of the second tension link being pivotally coupled together by a pivot connection for movement with the linkage between the folded condition and the extended condition;

wherein when the linkage is in the extended condition, the first and second tension links are substantially aligned with one another so as to be arranged to be supported under tension to restrict displacement of the link pivot means away from the wall; and wherein when the linkage is in the folded condition, the first and second tension links are folded at the pivot connection; and linkage release means for releasing the linkage and the linkage retaining means from the extended condition.

20. The seat panel according to claim 19 wherein the seat panel includes respective side flanges surrounding the recessed portion in the bottom side thereof, the side flange along a rear side of the seat being arranged to extend between the hinge and the wall in the use position of the seat panel for concealing the hinge in the use position.

* * * * *